US008823614B2

(12) United States Patent
Lee

(10) Patent No.: US 8,823,614 B2
(45) Date of Patent: Sep. 2, 2014

(54) APPARATUS AND METHOD FOR GENERATING GRAY-SCALE VOLTAGE, AND ORGANIC ELECTROLUMINESCENT DISPLAY DEVICE

(75) Inventor: Wook Lee, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 390 days.

(21) Appl. No.: 13/190,508

(22) Filed: Jul. 26, 2011

(65) Prior Publication Data

US 2012/0032995 A1 Feb. 9, 2012

(30) Foreign Application Priority Data

Aug. 5, 2010 (KR) ..... 10-2010-0075671

(51) Int. Cl.
*G09G 3/32* (2006.01)
*G09G 3/20* (2006.01)

(52) U.S. Cl.
CPC ..... *G09G 3/2011* (2013.01); *G09G 3/3233* (2013.01)
USPC ..... 345/82; 345/77

(58) Field of Classification Search
USPC ..... 345/76, 77, 690, 82; 313/484–487, 313/498–502; 315/169.1–169.4
See application file for complete search history.

(56) References Cited

U.S. PATENT DOCUMENTS

| | | | | |
|---|---|---|---|---|
| 6,762,741 | B2 * | 7/2004 | Weindorf | 345/102 |
| 2004/0196254 | A1 * | 10/2004 | Mizumaki | 345/103 |
| 2008/0106554 | A1 | 5/2008 | Tsai et al. | |
| 2009/0153593 | A1 * | 6/2009 | Lee et al. | 345/690 |
| 2009/0219306 | A1 * | 9/2009 | Oh et al. | 345/690 |
| 2010/0007680 | A1 * | 1/2010 | Yu et al. | 345/690 |
| 2011/0007101 | A1 * | 1/2011 | Mori | 345/690 |

FOREIGN PATENT DOCUMENTS

| | | | |
|---|---|---|---|
| JP | 2000-341716 | A | 12/2000 |
| KR | 10 2007-0011785 | A | 1/2007 |
| KR | 10-2007-0042376 | A | 4/2007 |

* cited by examiner

*Primary Examiner* — Chanh Nguyen
*Assistant Examiner* — Ram Mistry
(74) *Attorney, Agent, or Firm* — Lee & Morse, P.C.

(57) ABSTRACT

An apparatus and method for performing natural luminance adjustment by adjusting voltage levels of gray-scale voltages of a display device through a plurality of steps and determining gray-scale voltage levels of intermediate luminance levels using predetermined data when a luminance level of the display device is adjusted.

23 Claims, 11 Drawing Sheets

FIG. 6

| | | | | | | | | |
|---|---|---|---|---|---|---|---|---|
| Level 8 | CR7[8], CG7[8], CB7[8] | CR6[8], CG6[8], CB6[8] | CR5[8], CG5[8], CB5[8] | CR4[8], CG4[8], CB4[8] | CR3[8], CG3[8], CB3[8] | CR2[8], CG2[8], CB2[8] | CR1[8], CG1[8], CB1[8] | CR0[8], CG0[8], CB0[8] |
| Level 7 | CR7[7], CG7[7], CB7[7] | CR6[7], CG6[7], CB6[7] | CR5[7], CG5[7], CB5[7] | CR4[7], CG4[7], CB4[7] | CR3[7], CG3[7], CB3[7] | CR2[7], CG2[7], CB2[7] | CR1[7], CG1[7], CB1[7] | CR0[7], CG0[7], CB0[7] |
| Level 6 | CR7[6], CG7[6], CB7[6] | CR6[6], CG6[6], CB6[6] | CR5[6], CG5[6], CB5[6] | CR4[6], CG4[6], CB4[6] | CR3[6], CG3[6], CB3[6] | CR2[6], CG2[6], CB2[6] | CR1[6], CG1[6], CB1[6] | CR0[6], CG0[6], CB0[6] |
| Level 5 | CR7[5], CG7[5], CB7[5] | CR6[5], CG6[5], CB6[5] | CR5[5], CG5[5], CB5[5] | CR4[5], CG4[5], CB4[5] | CR3[5], CG3[5], CB3[5] | CR2[5], CG2[5], CB7[5] | CR1[5], CG1[5], CB1[5] | CR0[5], CG0[5], CB0[5] |
| Level 4 | CR7[4], CG7[4], CB7[4] | CR6[4], CG6[4], CB6[4] | CR5[4], CG5[4], CB5[4] | CR4[4], CG4[4], CB4[4] | CR3[4], CG3[4], CB3[4] | CR2[4], CG2[4], CB2[4] | CR1[4], CG1[4], CB1[4] | CR0[4], CG0[4], CB0[4] |
| Level 3 | CR7[3], CG7[3], CB7[3] | CR6[3], CG6[3], CB6[3] | CR5[3], CG5[3], CB5[3] | CR4[3], CG4[3], CB4[3] | CR3[3], CG3[3], CB3[3] | CR2[3], CG2[3], CB2[3] | CR1[3], CG1[3], CB1[3] | CR0[3], CG0[3], CB0[3] |
| Level 2 | CR7[2], CG7[2], CB7[2] | CR6[2], CG6[2], CB6[2] | CR5[2], CG5[2] CB5[2] | CR4[2], CG4[2], CB4[2] | CR3[2], CG3[2], CB3[2] | CR2[2], CG2[2], CB2[2] | CR1[2], CG1[2], CB1[2] | CR0[2], CG0[2], CB0[2] |
| Level 1 | CR7[1], CG7[1], CB7[1] | CR6[1], CG6[1], CB6[1] | CR5[1], CG5[1], CB5[1] | CR4[1], CG4[1], CB4[1] | CR3[1], CG3[1], CB3[1] | CR2[1], CG2[1], CB2[1] | CR1[1], CG1[1], CB1[1] | CR0[1], CG0[1], CB0[1] |
| Level 0 | CR7[0], CG7[0], CB7[0] | CR6[0], CG6[0], CB6[0] | CR5[0], CG5[0], CB5[0] | CR4[0], CG4[0], CB4[0] | CR3[0], CG3[0], CB3[0] | CR2[0], CG2[0], CB20] | CR1[0], CG1[0], CB1[0] | CR0[0], CG0[0], CB0[0] |

APPARATUS AND METHOD FOR GENERATING GRAY-SCALE VOLTAGE, AND ORGANIC ELECTROLUMINESCENT DISPLAY DEVICE

BACKGROUND

1. Field

Embodiments relate to an apparatus for generating a gray-scale voltage, a method for generating a gray-scale voltage, and an organic electroluminescent display device including the apparatus.

2. Description of the Related Art

A display device displays an image corresponding to an input image by applying scanning signals and data voltages to a plurality of pixels. The data voltage supplied to each pixel is generated by a data driver of the display device. The data driver of the display device performs a digital-analog conversion of the digital signal input image data. In the digital-analog conversion, gray-scale voltages corresponding to respective gray scales are used. The gray-scale voltages are generated by using a gamma correction circuit or others.

An organic electroluminescent display device includes Organic Light Emitting Diodes (OLEDs), which are self light-emitting devices. The OLEDs are self light-emitting devices for individual pixels. The individual pixels receive data voltages, generate driving currents, and supply the driving currents to the corresponding OLEDs. Thus, the OLEDs emit light having a luminance level according to the magnitude of each of the driving currents.

SUMMARY

Embodiments are therefore directed to an organic electroluminescent display device, which substantially overcome one or more of the problems due to the limitations and disadvantages of the related art.

It is therefore a feature of an embodiment to provide an organic electroluminescent display device capable of natural dimming.

It is therefore another feature of an embodiment to provide an organic electroluminescent display device capable of dimming without a change of color temperature when the dimming is performed by controlling a gray-scale voltage.

At least one of the above and other features and advantages may be realized by providing a method for generating a gray-scale voltage in a display device, the method including: receiving a target luminance level different from a current luminance level; searching a reference voltage table containing gamma circuit control signals for a plurality of luminance levels for a gamma circuit control signal for the target luminance level and a gamma circuit control signal for at least one intermediate luminance level between the current luminance level and the target luminance level; and adjusting a luminance level by adjusting gray-scale voltages of the display device through a plurality of steps from the current luminance level to the target luminance level using the gamma circuit control signals found from the reference voltage table, wherein the gamma circuit control signals are control signals for controlling voltage levels of the gray-scale voltages of the display device.

The gamma circuit control signals may be control signals for determining voltage levels of a plurality of reference voltages used for generating the gray-scale voltages.

The reference voltage table may include gamma circuit control signals for color components corresponding to respective sub-pixels on the plurality of luminance levels.

The reference voltage table may include gamma circuit control signals adjusted not to change color temperature of an image displayed on the display device in the plurality of luminance levels.

The number of the plurality of steps may be predetermined, the method may further include: determining whether the number of intermediate luminance levels searched from the reference voltage table is not enough to adjust the gray-scale voltages of the display device through the predetermined number of plurality of steps; determining, if the number of intermediate luminance levels is not enough, at least one additional intermediate luminance level by interpolating among the current luminance level, the intermediate luminance levels, and the target luminance level searched from the reference voltage table; and generating a gamma circuit control signal corresponding to the at least one additional intermediate luminance level, and adjusting of the luminance level through a plurality of steps using the gamma circuit control signals found from the reference voltage table and the gamma circuit control signal corresponding to the at least one additional intermediate luminance level.

The method may further include: determining whether the target luminance level exists in the reference voltage table; and generating, if the target luminance level does not exist in the reference voltage table, the gamma circuit control signal corresponding to the target luminance level by interpolating the gamma circuit control signals for the luminance levels included in the reference voltage table or parameters related to the gamma circuit control signals.

The target luminance level may be determined according to a user's input for adjusting a luminance level. In this case, the user's input for adjusting a luminance level may be limited to selecting the luminance level from only the luminance levels included in the reference voltage table.

The display device may be an organic electroluminescent display device.

At least one of the above and other features and advantages may also be realized by providing an apparatus for generating a gray-scale voltage in a display device, the apparatus including: a gamma correction circuit for generating and outputting a plurality of gray-scale voltages; a reference voltage table storage for storing a reference voltage table containing gamma circuit control signals for controlling the gamma correction circuit for a plurality of luminance levels; and a gamma circuit control signal generator for receiving a current luminance level and a target luminance level, and if the current luminance level is different from the target luminance level, searching the reference voltage table for a gamma circuit control signal for the target luminance level and a gamma circuit control signal for at least one intermediate luminance level between the current luminance level and the target luminance level, and controlling to adjust a luminance level of the display device by adjusting the plurality of gray-scale voltages through a plurality of steps from the current luminance level to the target luminance level using the gamma circuit control signals found from the reference voltage table.

The gamma circuit control signals may be control signals for determining voltage levels of a plurality of reference voltages used for generating the gray-scale voltages in the gamma correction circuit.

The reference voltage table may include gamma circuit control signals for color components corresponding to respective sub-pixels on the plurality of luminance levels.

The reference voltage table may include gamma circuit control signals adjusted not to change color temperature of an image displayed on the display device in the plurality of luminance levels.

The number of the plurality of steps may be predetermined, the apparatus may further include an interpolator for, if the number of intermediate luminance levels searched from the reference voltage table is not enough to adjust the gray-scale voltages of the display device through the predetermined number of plurality of steps, determining at least one additional intermediate luminance level by interpolating among the current luminance level, the intermediate luminance levels, and the target luminance level searched from the reference voltage table and generating a gamma circuit control signal corresponding to the at least one additional intermediate luminance level, and the gamma circuit control signal generator may adjust the luminance level through a plurality of steps using the gamma circuit control signals found from the reference voltage table and the gamma circuit control signal corresponding to the at least one additional intermediate luminance level.

The apparatus may further include an interpolator for, if the target luminance level does not exist in the reference voltage table, generating the gamma circuit control signal corresponding to the target luminance level by interpolating the gamma circuit control signals for the luminance levels included in the reference voltage table or parameters related to the gamma circuit control signals.

The target luminance level may be determined according to a user's input for adjusting a luminance level.

The user's input for adjusting a luminance level may be limited to selecting the luminance level from only the luminance levels included in the reference voltage table.

The display device may be an organic electroluminescent display device.

An organic electroluminescent display device may include: a plurality of pixels disposed on crossing points between data lines and scanning lines; a gate driver for outputting scanning signals to the plurality of pixels through the scanning lines, respectively; a data driver for generating data voltages corresponding to an input image input to the organic electroluminescent display device from a plurality of gray-scale voltages and outputting the data voltages to the plurality of pixels through the data lines, respectively; and a gray-scale voltage generator for generating the plurality of gray-scale voltages and outputting the plurality of gray-scale voltages to the data driver, wherein the gray-scale voltage generator includes: a gamma correction circuit for generating and outputting a plurality of gray-scale voltages; a reference voltage table storage for storing a reference voltage table containing gamma circuit control signals for controlling the gamma correction circuit for a plurality of luminance levels; and a gamma circuit control signal generator for receiving a current luminance level and a target luminance level, and if the current luminance level is different from the target luminance level, searching the reference voltage table for a gamma circuit control signal for the target luminance level and a gamma circuit control signal for at least one intermediate luminance level between the current luminance level and the target luminance level, and controlling to adjust a luminance level of the organic electroluminescent display device by adjusting the plurality of gray-scale voltages through a plurality of steps from the current luminance level to the target luminance level using the gamma circuit control signals found from the reference voltage table.

BRIEF DESCRIPTION OF THE DRAWINGS

The above and other features and advantages will become more apparent to those of ordinary skill in the art by describing in detail exemplary embodiments with reference to the attached drawings, in which:

FIG. 6 illustrates a reference voltage table according to an exemplary embodiment;

DETAILED DESCRIPTION

Korean Patent Application No. 10-2010-0075671, filed on Aug. 5, 2010, in the Korean Intellectual Property Office, and entitled: "Apparatus and Method for Generating Gray-Scale Voltage, and Organic Electroluminescent Display Device," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

The following description and the accompanying drawings are provided to assist in a comprehensive understanding of operations according to the present invention, and parts easily implemented by those of ordinary skill in the art can be omitted. In addition, the specification and the accompanying drawings are provided for illustration purpose only and not for the purpose of limiting the invention as defined by the appended claims and their equivalents. The terminology or words used in the specification and claims described below must be analyzed as the meaning and concept conforming the technical spirit of the present inventive concept.

Figure 1:
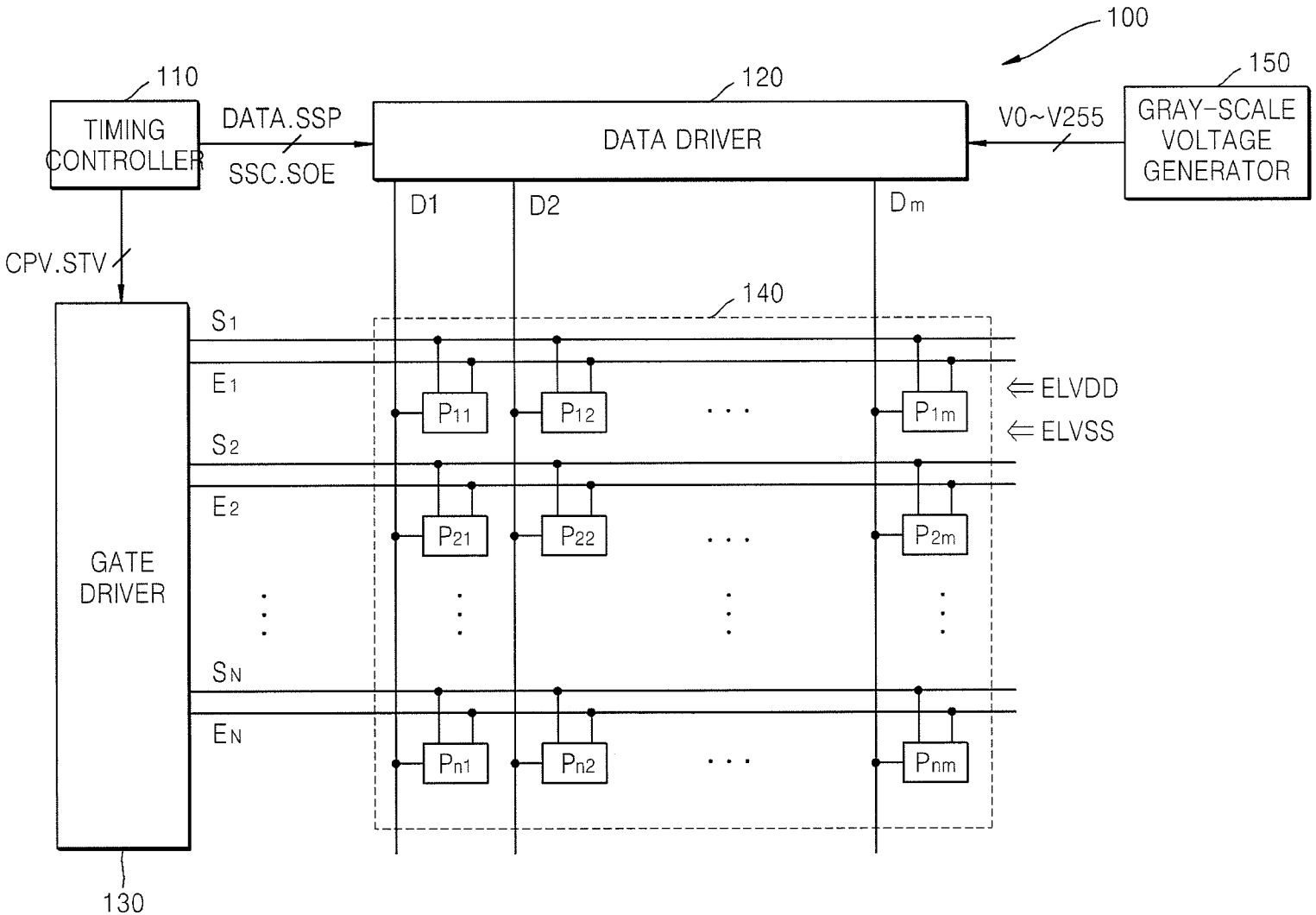
FIG. 1 illustrates a block diagram of an organic electroluminescent display device according to an exemplary embodiment.

FIG. 1 is a block diagram illustrating an organic electroluminescent display device 100 according to an exemplary embodiment.

Referring to FIG. 1, the organic electroluminescent display device 100 includes a timing controller 110 for generating control signals and outputting the control signals to a data driver 120 and a gate driver 130. The data driver 120 outputs data voltages corresponding to an input image to a plurality of pixels $P_{11}$ to $P_{nm}$, through data lines $D_1$ to $D_m$, respectively. The gate driver 130 outputs scanning signals to the plurality of pixels $P_{11}$ to $P_{nm}$ through scanning lines $S_1$ to $S_n$, respectively. A pixel unit 140 includes the plurality of pixels $P_{11}$ to $P_{nm}$ connected with the scanning lines $S_1$ to $S_n$, light-emitting control lines $E_1$ to $E_n$, and the data lines $D_1$ to $D_m$. A gray-scale voltage generator 150 generates a plurality of gray-scale voltages V0 to V255 and supplies the plurality of gray-scale voltages V0 to V255 to the data driver 120.

The timing controller 110 receives an input image signal and an input control signal for controlling the display of the input image from an external graphic controller (not shown). The timing controller 110 generates input image data DATA, a source start pulse SSP, a source shift clock SSC, and a source output enable signal SOE from the input image signal and the input control signal and provides the generated signals to the data driver 120. The timing controller 110 also generates a gate driving clock CPV and a start pulse STV and outputs the generated signals to the gate driver 130.

The pixel unit 140 includes the pixels $P_{11}$ to $P_{nm}$ disposed on crossing points between the scanning lines $S_1$ to $S_n$ and the data lines $D_1$ to $D_m$. The pixels $P_{11}$ to $P_{nm}$ can be arranged in the form of an m×n matrix, as shown in FIG. 1. Each of the pixels $P_{11}$ to $P_{nm}$, includes a light-emitting device and receives a high source voltage ELVDD and a low source voltage ELVSS. The high source voltage ELVDD and a low source voltage ELVSS are used for the light-emitting device to emit light from the outside. In addition, each of the pixels $P_{11}$ to $P_{nm}$ activates the light-emitting device to emit light with a luminance level corresponding to the data voltage by providing a driving current or voltage to the light-emitting device. The light-emitting device may be an Organic Light-Emitting Diode (OLED).

The individual pixels $P_{11}$ to $P_{nm}$ control the amount of current supplied to the OLEDs in correspondence with the data voltages delivered through the data lines $D_1$ to $D_m$.

The OLEDs emit light with luminance levels corresponding to the data voltages in response to light-emitting control signals delivered through the light-emitting control lines $E_1$ to $E_n$.

Figure 2:
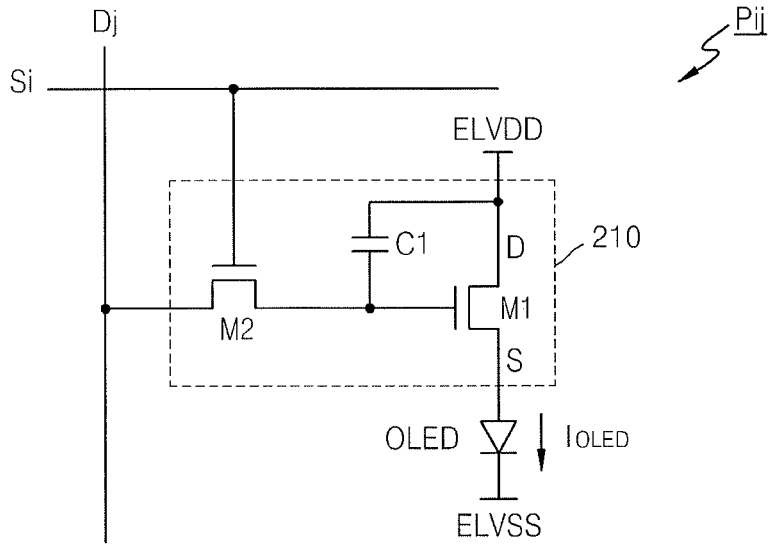
FIG. 2 illustrates a circuit diagram of an illustrative pixel $P_{ij}$.

FIG. 2 is a circuit diagram showing a structure of an illustrative pixel P. Pixel circuits 210, according to an exemplary embodiment, can be implemented with an N-type transistor or a P-type transistor. Hereinafter, exemplary embodiments will be described based on a pixel circuit 210 implemented with an N-type transistor.

The pixel $P_{ij}$ includes an OLED and the pixel circuit 210. The OLED receives a driving current $I_{OLED}$ output from the pixel circuit 210 and emits light. The OLED also emits a luminance level of the light depending on the magnitude of the driving current $I_{OLED}$.

The pixel circuit 210 can include a capacitor C1, a driving transistor M1, and a scanning transistor M2. The driving transistor M1 includes a first terminal D for receiving the high source voltage ELVDD, a second terminal S connected to an anode of the OLED, and a gate terminal connected to a second terminal of the scanning transistor M2. The anode of the OLED is connected to the second terminal S of the driving transistor M1, and a cathode thereof is connected to the low source voltage ELVSS. The scanning transistor M2 includes a first terminal connected to a data line $D_j$, a second terminal connected to the gate terminal of the driving transistor M1, and a gate terminal connected to a scanning line $S_i$. The capacitor C1 is connected between the gate terminal and the first terminal D of the driving transistor M1.

If a scanning signal having a gate-on level is applied to the scanning transistor M2, the data voltage is applied to the gate terminal of the driving transistor M1 and a first terminal of the capacitor C1 through the scanning transistor M2. While a valid data voltage is being applied through the data line $D_j$, a level corresponding to the data voltage is charged into the capacitor C1. The driving transistor M1 generates the driving current $I_{OLED}$ according to a voltage level of the data voltage and outputs the driving current $I_{OLED}$ to the OLED.

The OLED receives the driving current $I_{OLED}$ from the pixel circuit 210 and emits light with a luminance level corresponding to the data voltage.

The data driver 120 generates the data voltages using the input image data DATA, the source start pulse SSP, the source shift clock SSC, and the source output enable signal SOE input from the timing controller 110. The data driver 120 outputs the data voltages to the plurality of pixels $P_{11}$ to $P_{nm}$ through the data lines $D_1$ to $D_m$. The data voltages can be output to a plurality of pixels disposed in the same row during one horizontal period. In addition, each of the plurality of data lines $D_1$ to $D_m$ transmitting the data voltages can be connected to a plurality of pixels disposed in the same column.

Figure 3:
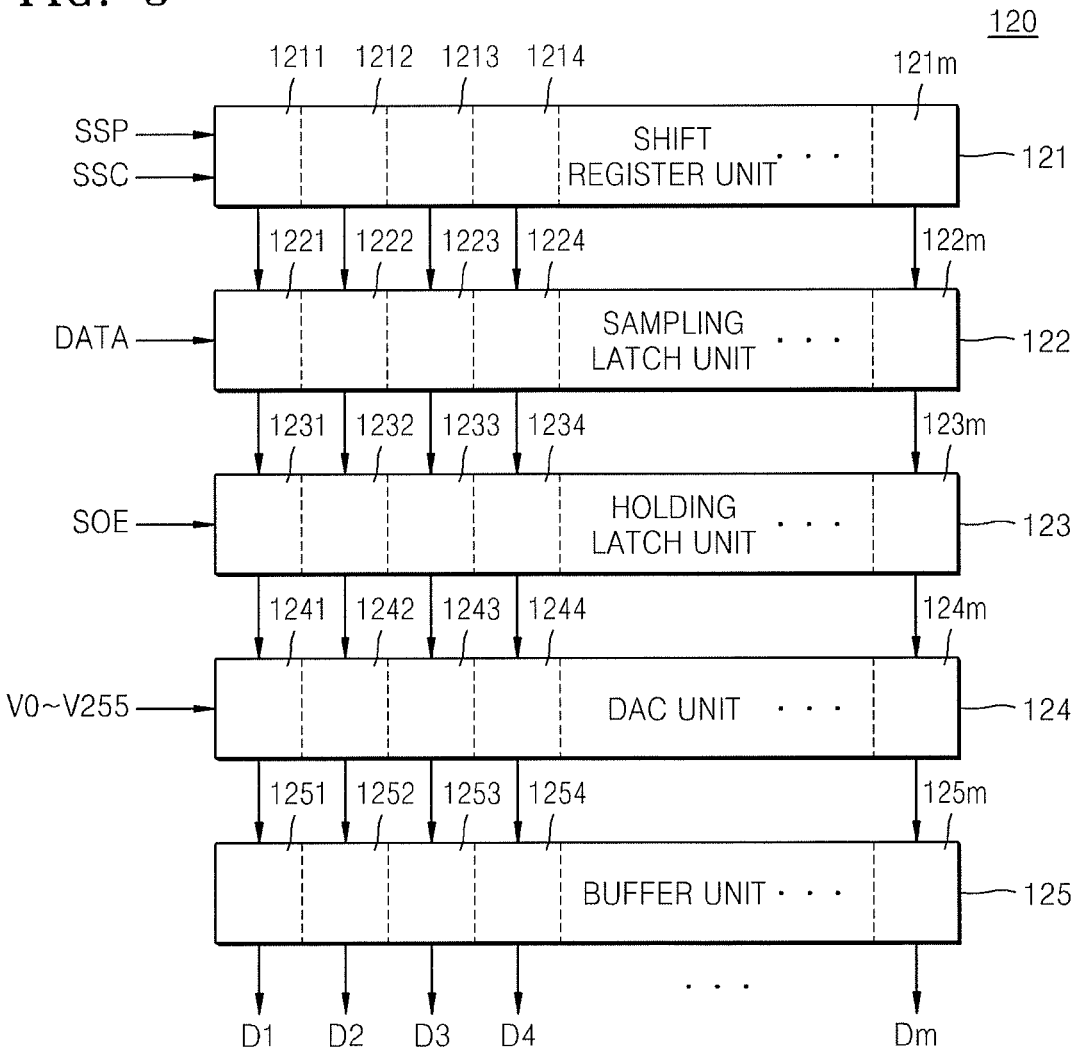
FIG. 3 illustrates a block diagram of a data driver according to an exemplary embodiment.

FIG. 3 is a block diagram illustrating a structure of the data driver 120 according to an exemplary embodiment of the present invention.

Referring to FIG. 3, the data driver 120 includes a shift register unit 121, a sampling latch unit 122, a holding latch unit 123, a Digital-Analog Converter (DAC) unit 124, and a buffer unit 125.

The shift register unit 121 receives the source start pulse SSP and the source shift clock SSC from the timing controller 110. Upon receiving the source start pulse SSP and the source shift clock SSC, the shift register unit 121 generates m sampling signals in sequence by shifting the source start pulse SSP per period of the source shift clock SSC. To generate m sampling signals in sequence, the shift register unit 121 includes m shift registers 121*l* to 121*m*.

The sampling latch unit 122 sequentially stores the input image data DATA in response to the m sampling signals sequentially provided from the shift register unit 121. To store the input image data DATA, the sampling latch unit 122 includes m sampling latches 122*l* to 122*m* to store m pieces of the input image data DATA.

The holding latch unit 123 receives the source output enable signal SOE from the timing controller 110. Upon receiving the source output enable signal SOE, the holding latch unit 123 receives the input image data DATA from the sampling latch unit 122 and stores the received input image data DATA. The holding latch unit 123 provides the input image data DATA stored therein to the DAC unit 124. To provide the input image data DATA stored therein, the holding latch unit 123 includes m holding latches 1231 to 123*m*.

The DAC unit 124 receives the input image data DATA from the holding latch unit 123 and the gray-scale voltages V0 to V255 from the gray-scale voltage generator 150, and generates m data voltages in response to the received input image data DATA. To generate m data voltages in response to the received image data DATA, the DAC unit 124 includes m DACs 124*l* to 124*m*. The DAC unit 124 generates m data voltages using the DACs 124*l* to 124*m* disposed per channel and provides the generated data voltages to the buffer unit 125.

The buffer unit 125 provides the m data voltages, which have been received from the DAC unit 124, to the m data lines $D_1$ to $D_m$. To provide the m data voltages, the buffer unit 125 includes m buffers 125*l* to 125*m*.

The gate driver 130 generates scanning signals and light-emitting control signals using the gate driving clock CPV and the start pulse STV input from the timing controller 110 and outputs the scanning signals and the light-emitting control signals to the plurality of pixels $P_{11}$ to $P_{nm}$ through the scanning lines $S_1$ to $S_n$ and the light-emitting control lines $E_1$ to $E_n$, respectively. Each of the scanning lines $S_1$ to $S_n$ and each of the light-emitting control lines $E_1$ to $E_n$ can be connected to a plurality of pixels disposed in the same column. The scanning lines $S_1$ to $S_n$ and the light-emitting control lines $E_1$ to $E_n$ can transmit scanning signals and light-emitting control signals in sequence on a row unit basis or at the same time. According to an embodiment of the organic electroluminescent display device 100, the gate driver 130 can generate additional driving signals and output the additional driving signals to the plurality of pixels $P_{11}$ to $P_{nm}$.

The gray-scale voltage generator 150 generates the gamma corrected gray-scale voltages V0 to V255 and outputs the plurality of gamma corrected gray-scale voltages V0 to V255 to the data driver 120. The number of plurality of gamma corrected gray-scale voltages V0 to V255 depends on the number of gray-scales expressed by the organic electroluminescent display device 100. In the present embodiment, the description will be made based on the organic electroluminescent display device 100 with 256 gray-scales.

According to the exemplary embodiments of the present invention, when dimming is performed in the organic electroluminescent display device 100, the gray-scale voltage generator 150 performs the dimming by adjusting levels of the gray-scale voltages V0 to V255 over a plurality of dimming steps. In addition, the gray-scale voltages V0 to V255 are output through the plurality of dimming steps, and are generated with reference to a pre-stored reference voltage table.

Figure 4:
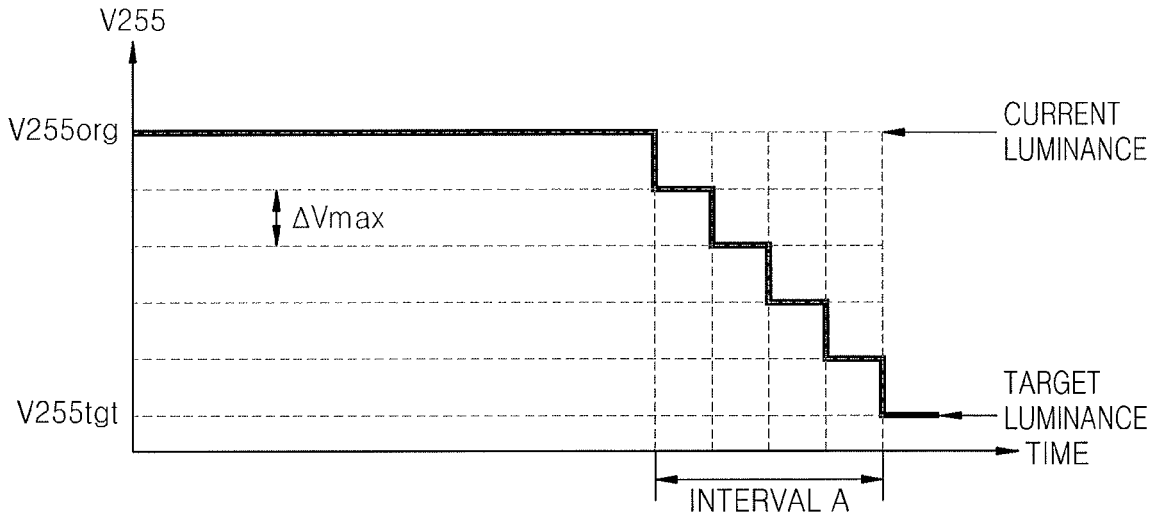
FIG. 4 illustrates a graph of a dimming operation according to an exemplary embodiment.

FIG. 4 is a graph of a dimming operation according to an exemplary embodiment.

The dimming operation steadily decreases a luminance level of the organic electroluminescent display device 100 during a predetermined time interval. Although the description will be made based on dimming in the present embodiment, the exemplary embodiments can be applied to all operations that change a luminance level of the organic electroluminescent display device 100. Thus, the exemplary embodiments include, not only exemplary embodiments of decreasing a luminance level, but also exemplary embodiments of increasing a luminance level. A luminance change of the organic electroluminescent display device 100 can be performed by a user's input, outside light, a battery voltage, etc.

As illustrated in FIG. 4, according to the exemplary embodiments, when a luminance level of the organic electroluminescent display device 100 is controlled, dimming is performed by adjusting voltage levels of the gray-scale voltages V0 to V255. Thus, when a luminance level of the organic electroluminescent display device 100 is decreased, the luminance level is decreased by adjusting the voltage levels of the gray-scale voltages V0 to V255 from a current luminance gray-scale voltage level V255org to a target luminance gray-scale voltage level V255tgt. Therefore, during a predetermined time (interval A), the voltage levels of the gray-scale voltages V0 to V255 are decreased step-by-step over a predetermined number of dimming steps. For example, the interval A may be a time interval of 400~600 ms.

According to the exemplary embodiments, the voltage levels of the gray-scale voltages V0 to V255 in the respective dimming steps are determined with reference to a pre-stored reference voltage table. The voltage levels of the gray-scale voltages V0 to V255 in the dimming steps correspond to gamma circuit control signals GCON included in the pre-stored reference voltage table. Therefore, according to an exemplary embodiment, while the dimming is being performed, the gray-scale voltages V0 to V255 decrease through voltage levels corresponding to the gamma circuit control signals GCON included in the pre-stored reference voltage table.

FIG. 4 illustrates an exemplary embodiment of controlling dimming with a voltage level of a $255^{th}$ gray-scale voltage V255. Dimming control of the other gray-scale voltages V0 to V254 is similar to the dimming control of the $255^{th}$ gray-scale voltage V255 illustrated in FIG. 4.

The pre-stored reference voltage table can store gamma circuit control signals GCON corresponding to respective luminance levels. A gamma circuit can generate the gray-scale voltages V0 to V255 from a predetermined number of reference voltages, and each gamma circuit control signal GCON may be a control signal input to selectors for generating reference voltages in a gamma correction circuit. Each gamma circuit control signal GCON may be a set of control signals corresponding to a plurality of reference voltages. For example, the pre-stored reference voltage table may include a set of gamma circuit control signals GCON for controlling voltage levels of all gray-scale voltages V0 to V255. In the present exemplary embodiment, the description will be made based on the reference voltage table including a set of gamma circuit control signals GCON input to selectors for generating reference voltages.

Figure 5:
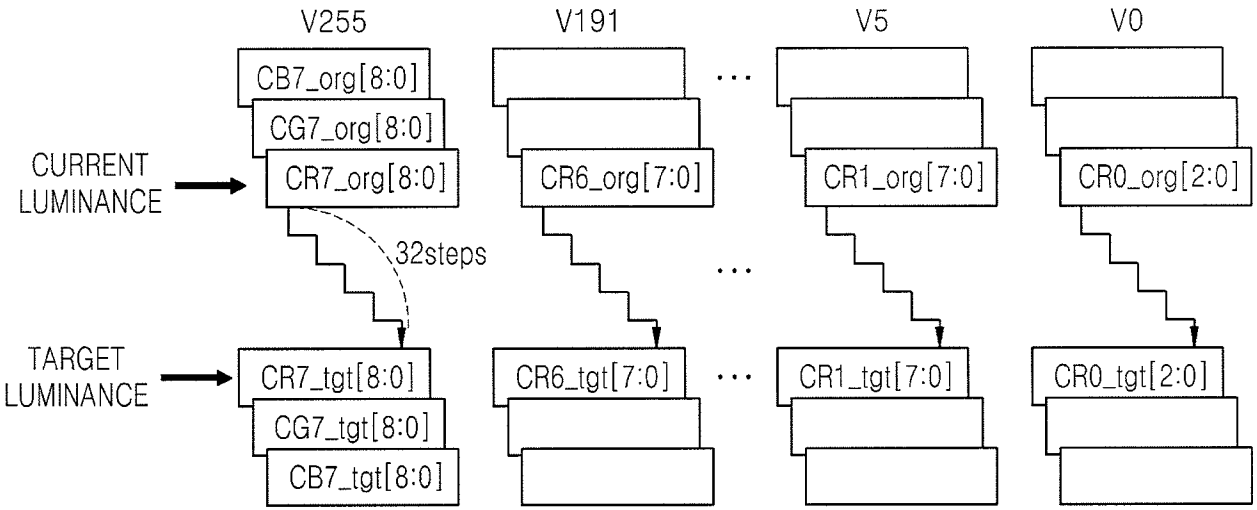
FIG. 5 illustrates a diagram of controlling voltage levels of individual reference voltages in the dimming operation according to an exemplary embodiment.

FIG. 5 is a diagram of controlling voltage levels of individual reference voltages in the dimming operation according to an exemplary embodiment.

According to an exemplary embodiment of the dimming operation, a voltage level of each reference voltage is controlled through a predetermined number of dimming steps. FIG. 5 shows an exemplary embodiment in which a total of 8 reference voltages V0, V5, V15, V31, V63, V127, V 191, and V255 exist and gamma circuit control signals GCON (CR0 to CR7, CG0 to CG7, and CB0 to CB7 in the example of FIG. 6) corresponding to 8 luminance levels exist for controlling a voltage level of each of the reference voltages. As shown in FIG. 5, according to an exemplary embodiment of the present invention, in the dimming operation, the gamma circuit control signals GCON (CR0 to CR7, CG0 to CG7, and CB0 to CB7 in FIG. 6) are changed through a predetermined number of dimming steps from current luminance gamma circuit control signals GCON (CR0_org to CR7_org in the example of FIG. 5) corresponding to reference voltages of a current luminance level to target luminance gamma circuit control signals GCON (CR0_tgt to CR7_tgt in the example of FIG. 5) corresponding to reference voltages of a target luminance level. Gamma circuit control signals GCON of intermediate luminance levels are generated by searching the reference voltage table for reference voltage levels corresponding to the intermediate luminance levels for the gamma circuit control signals GCON. For the gamma circuit control signals GCON, the intermediate luminance levels are between the current luminance and the target luminance level.

The gamma circuit control signals GCON are individually stored and controlled for R, G, and B. That is, gamma circuit control signals GCON (CR0 to CR7 in FIG. 6) for R, gamma circuit control signals GCON (CG0 to CG7 in FIG. 6) for G, and gamma circuit control signals GCON (CB0 to CB7 in FIG. 6) for B are individually stored in the reference voltage table and independently generated in the dimming operation.

In the dimming operation, if reference voltage levels of intermediate luminance levels are determined using interpolation for reference voltages between a current luminance level and a target luminance level, image quality of an image displayed on the organic electroluminescent display device 100 may be deteriorated due to a change of color temperature in the intermediate luminance levels. According to exemplary embodiments of the dimming operation, the deterioration of image quality of a display image due to a change of color temperature in intermediate luminance levels can be prevented by determining reference voltage levels of the intermediate luminance levels using a pre-defined reference voltage table.

In particular, according to exemplary embodiments, reference voltage levels are defined and stored in advance for each of a plurality of luminance levels. Reference voltage levels for R, G, and B are defined and stored in advance for each of a plurality of luminance levels. According to exemplary embodiments, a change of color temperature of an image displayed on the organic electroluminescent display device 100 during a dimming control over the entire gray-scale range can be prevented. During a dimming operation, pre-defining all reference voltage levels for a plurality of luminance levels and performing dimming through the pre-defined reference voltage levels will prevent a change of color temperature. According to exemplary embodiments, a change of color temperature of a display image due to an inappropriate combination of gray-scale voltages of R, G, and B during a dimming control can be prevented by pre-defining reference voltage levels for R, G, and B for each of a plurality of luminance levels.

FIG. 6 illustrates a reference voltage table according to an exemplary embodiment.

The reference voltage table can include gamma circuit control signals for each of a plurality of luminance levels. FIG. 6 shows an example of respective gamma circuit control signals corresponding to $0^{th}$ to $8^{th}$ luminance levels Level 0 to Level 8. The reference voltage table can include gamma circuit control signals for each reference voltage. As illustrated in FIG. 6, the reference voltage table includes gamma circuit control signals GCON (CR0[8] to CR7[8]) for the $8^{th}$ luminance level and gamma circuit control signals GCON (CR0[7] to CR7[7]) for the $7^{th}$ luminance level. The reference voltage table can include gamma circuit control signals GCON for R, G, and B. For example, as illustrated in FIG. 6, the reference voltage table can include a gamma circuit control signal GCON (CR7[8]) for R, a gamma circuit control signal GCON (CG7[8]) for G, and a gamma circuit control signal GCON (CB7[8]) for B to determine a $255^{th}$ gray-scale voltage corresponding to a the lowest reference voltage of the $8^{th}$ luminance level.

Figure 7:
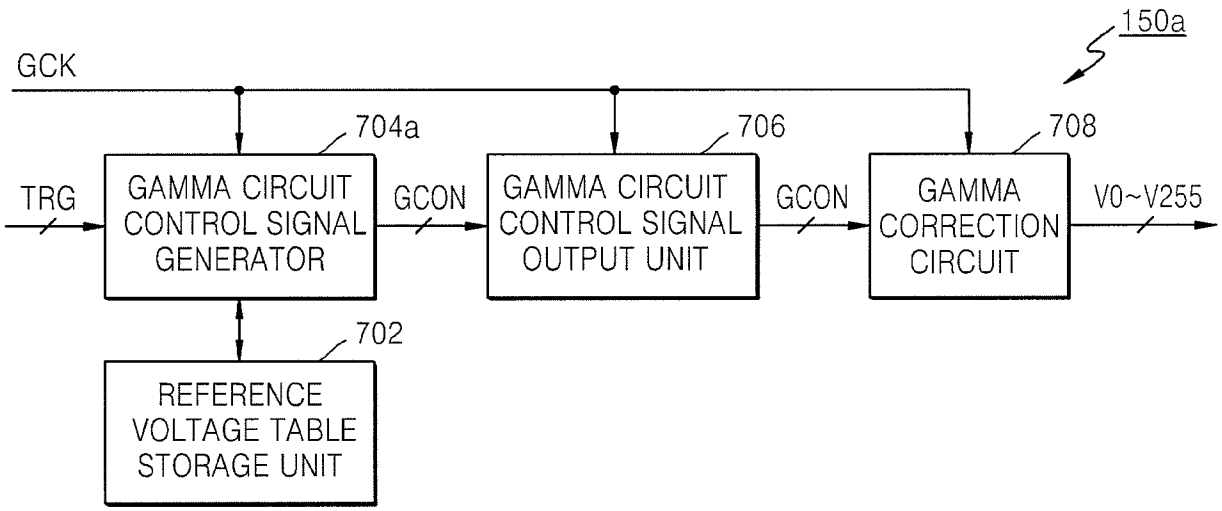
FIG. 7 illustrates a block diagram of a gray-scale voltage generator according to an exemplary embodiment.

FIG. 7 is a block diagram illustrating a gray-scale voltage generator 150*a* according to an exemplary embodiment of the present invention.

The gray-scale voltage generator 150*a* includes a reference voltage table storage unit 702, a gamma circuit control signal generator 704*a*, a gamma circuit control signal output unit 706, and a gamma correction circuit 708.

The reference voltage table storage unit 702 stores a reference voltage table containing gamma circuit control signals according to luminance levels. The reference voltage table can be stored in the form illustrated in FIG. 6.

The gamma circuit control signal generator 704*a* generates a gamma circuit control signal GCON to be provided to the gamma correction circuit 708. According to exemplary embodiments, a luminance level of the organic electroluminescent display device 100 can be adjusted by adjusting magnitudes of gray-scale voltages V0 to V255 output from the gamma correction circuit 708. The gamma circuit control signal generator 704*a* adjusts a luminance level of the organic electroluminescent display device 100 by receiving target luminance information TRG indicating the luminance level of the organic electroluminescent display device 100 and determining the gamma circuit control signal GCON to be provided to the gamma correction circuit 708. The gamma circuit control signal GCON can be independently determined for R, G, and B.

According to an exemplary embodiment, if a target luminance level indicated by the target luminance information TRG is changed, the gamma circuit control signal generator 704*a* generates a gamma circuit control signal GCON in each dimming step in order to change a luminance level of the organic electroluminescent display device 100. The gamma circuit control signal generator 704*a* searches the reference voltage table storage unit 702 for a gamma circuit control signal GCON corresponding to the target luminance level and gamma circuit control signals GCON corresponding to intermediate luminance levels. The intermediate luminance levels are between a current luminance level and the target luminance level. The number of intermediate luminance levels can be determined according to the number of dimming steps. The gamma circuit control signal generator 704*a* determines gamma circuit control signals GCON in respective dimming steps using the gamma circuit control signals GCON found from the reference voltage table storage unit 702.

The gamma circuit control signal output unit 706 outputs the gamma circuit control signal GCON generated by the gamma circuit control signal generator 704*a* to the gamma correction circuit 708. The gamma circuit control signal output unit 706 can output the gamma circuit control signal GCON in each clock period of a gamma circuit clock signal GCK by being synchronized with the gamma circuit clock signal GCK. The gamma circuit control signal output unit 706 can output the gamma circuit control signal GCON in order to adjust a luminance level in steps. When a luminance level is changed, step-by-step, the gamma circuit control signal generator 704*a* outputs the gamma circuit control signals GCON corresponding to the intermediate luminance levels and the target luminance level. The gamma circuit control signal generator 704*a* outputs the gamma circuit control signals GCON to the gamma circuit control signal output unit 706 in sequence, i.e. every clock period of the gamma circuit clock signal GCK. The gamma circuit control signal output unit 706 outputs the gamma circuit control signal GCON received from the gamma circuit control signal generator 704*a* to the gamma correction circuit 708 in synchronization with the gamma circuit clock signal GCK. The gamma circuit control signal output unit 706 may be a flip-flop or latch that operates in synchronization with the gamma circuit clock signal GCK.

The gamma correction circuit 708 generates gray-scale voltages V0 to V255 according to the gamma circuit control signals GCON. The gamma circuit control signals GCON are output from the gamma circuit control signal output unit 706. The gamma correction circuit 708 outputs the gray-scale voltages V0 to V255 to the data driver 120.

Figure 8:
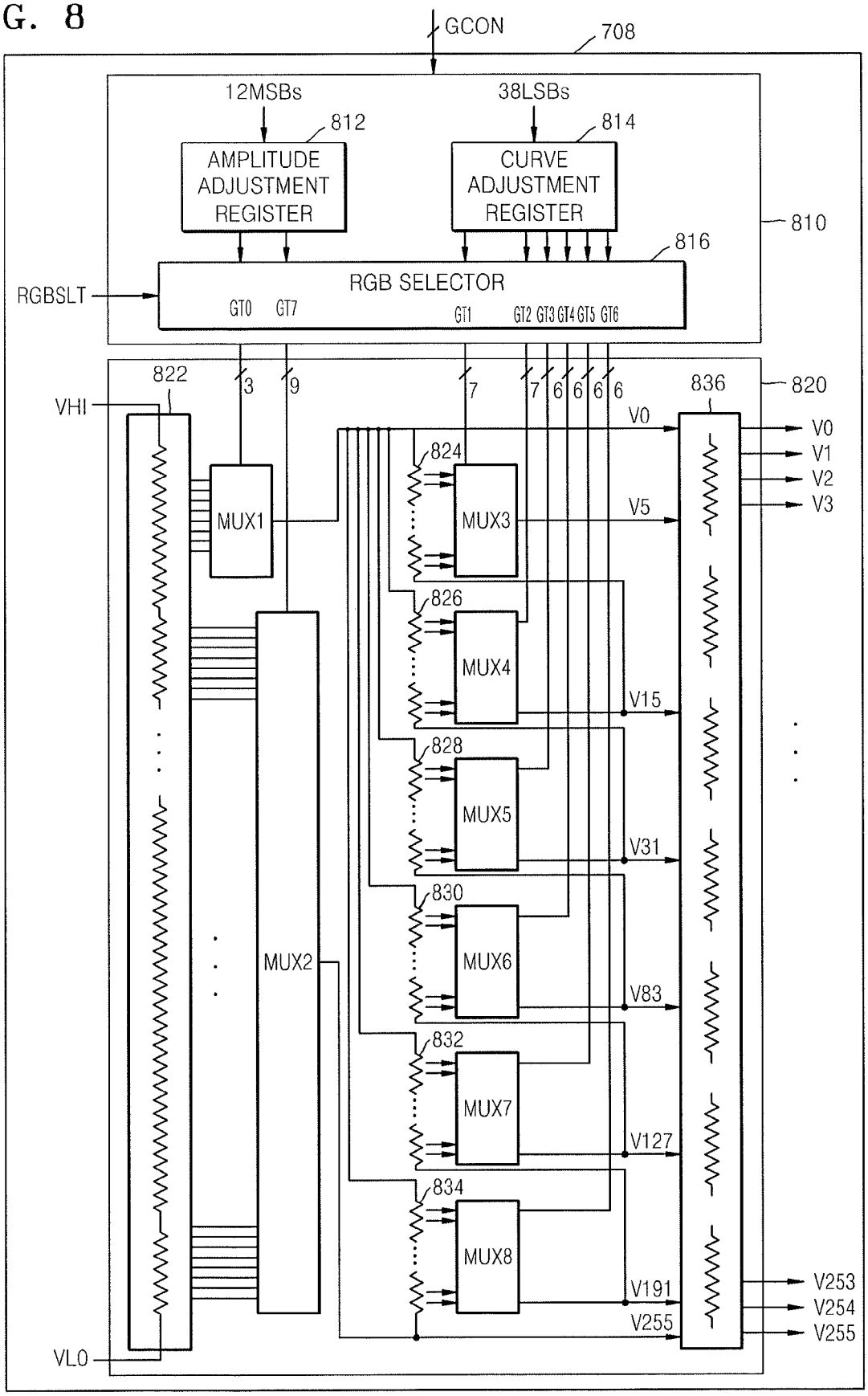
FIG. 8 illustrates a block diagram of a gamma correction circuit according to an exemplary embodiment.

FIG. 8 is a block diagram illustrating the gamma correction circuit 708 according to an exemplary embodiment.

Referring to FIG. 8, the gamma correction circuit 708 includes a logic unit 810 and a gamma unit 820. The logic unit 810 receives a gamma circuit control signal GCON output from the gamma circuit control signal output unit 706. The logic unit 810 outputs the gamma circuit control signal GCON to the gamma unit 820. The gamma unit 820 generates gray-scale voltages V0 to V255 according to the gamma circuit control signal GCON. The gamma circuit control signal GCON is output from the logic unit 810. The gamma unit 820 outputs the gray-scale voltages V0 to V255. According to an exemplary embodiment, voltage levels of reference voltages generated by the gamma unit 820 depend on the gamma circuit control signal GCON. The gamma unit 820 can include first to eighth selectors MUX1 to MUX8 to adjust the voltage levels of the reference voltages.

The logic unit 810 includes an amplitude adjustment register 812 and a curve adjustment register 814. The gamma circuit control signal GCON is composed of, for example, a 50-bit signal, wherein the 12 Most Significant Bits (MSBs) are input to the amplitude adjustment register 812 and the remaining 38 Least Significant Bits (LSBs) are input to the curve adjustment register 814. Therefore, the remaining 38 Least Significant Bits (LSBs) are being selected as register setup values.

The amplitude adjustment register 812 receives 12 MSBs of the gamma circuit control signal GCON and outputs 3 bits of the 12 MSBs of the gamma circuit control signal GCON to the first selector MUX1. The amplitude adjustment register 812 outputs the remaining 9 bits of the 12 MSBs of the gamma circuit control signal GCON to the second selector MUX2. The number of selectable gray-scales can increase by increasing the number of setup bits.

The curve adjustment register 814 receives the 38 LSBs of the gamma circuit control signal GCON and outputs the 38 LSBs of the gamma circuit control signal GCON to the third to eighth selectors MUX3 to MUX8 by dividing the 38 LSBs.

The logic unit 810 may further include an RGB selector 816. According to an exemplary embodiment of the present invention, when R, G, and B pixels are time-division driven, a single gamma unit 820 can be used for R, G, and B. The logic unit 810 can independently receive gamma circuit control signals GCON for R, G, and B and output the gamma circuit control signals GCON for R, G, and B to the gamma unit 820 in sequence according to driving timings of R, G, and B. In order to output the gamma circuit control signals GCON to the gamma unit 820 according to the driving timings of R, G, and B, the RGB selector 816 outputs the gamma circuit control signals GCON for R, G, and B to the gamma unit 820 in sequence according to an RGB selection signal RGBSLT.

The gamma unit 820 includes first to seventh ladder resistors 822, 824, 826, 828, 830, 832, and 834, the first to eighth selectors MUX1 to MUX8, and a gray-scale voltage output unit 836.

The first ladder resistor 822 has a structure in which the highest level voltage VHI supplied from the outside is defined as a reference voltage and a plurality of variable resistors are connected in series between a lowest level voltage VLO and the reference voltage. The first ladder resistor 822 generates highest gray-scale voltage candidates and lowest gray-scale voltage candidates by voltage-dividing the highest level voltage VHI and the lowest level voltage VLO. The highest gray-scale voltage candidates are output to the first selector MUX1, and the lowest gray-scale voltage candidates are output to the second selector MUX2. When a value of the first ladder resistor 822 is low, while adjustment accuracy increases, an amplitude adjustment range is narrow. However, when the value of the first ladder resistor 822 is high, while the adjustment accuracy decreases, the amplitude adjustment range is wide.

The first selector MUX1 receives the highest gray-scale voltage candidates from the first ladder resistor 822, selects one highest gray-scale voltage candidate corresponding to a value GT0 of the 3 bits of the gamma circuit control signal GCON, and outputs the selected highest gray-scale voltage candidate as the highest gray-scale voltage V0. The value GT0 of the 3 bits of the gamma circuit control signal GCON is set by the amplitude adjustment register 812.

The second selector MUX2 receives the lowest gray-scale voltage candidates from the first ladder resistor 822, selects one lowest gray-scale voltage candidate corresponding to a value GT7 of the 9 bits of the gamma circuit control signal GCON, and outputs the selected lowest gray-scale voltage candidate as the lowest gray-scale voltage V255. The value GT7 of the 9 bits of the gamma circuit control signal GCON is set by the amplitude adjustment register 812.

The second ladder resistor 824 divides a voltage between the gray-scale voltage V0 output from the first selector MUX1 and a gray-scale voltage V15 output from the fourth selector MUX4, and outputs the divided voltages to the third selector MUX3. The third selector MUX3 selects one voltage candidate corresponding to a value GT1 of 7 bits of the gamma circuit control signal GCON from among the voltage candidates output from the second ladder resistor 824, and outputs the selected voltage candidate as a fifth gray-scale voltage V5.

The third ladder resistor 826 divides a voltage between the gray-scale voltage V0 output from the first selector MUX1 and a gray-scale voltage V31 output from the fifth selector MUX5, and outputs the divided voltages to the fourth selector MUX4. The fourth selector MUX4 selects one voltage candidate corresponding to a value GT2 of 7 bits of the gamma circuit control signal GCON from among the voltage candidates output from the third ladder resistor 826, and outputs the selected voltage candidate as a fifteenth gray-scale voltage V15.

The fourth ladder resistor 828 divides a voltage between the gray-scale voltage V0 output from the first selector MUX1 and a gray-scale voltage V83 output from the sixth selector MUX6, and outputs the divided voltages to the fifth selector MUX5. The fifth selector MUX5 selects one voltage candidate corresponding to a value GT3 of 6 bits of the gamma circuit control signal GCON from among the voltage candidates output from the fourth ladder resistor 828, and outputs the selected voltage candidate as a $31^{st}$ gray-scale voltage V31.

The fifth ladder resistor 830 divides a voltage between the gray-scale voltage V0 output from the first selector MUX 1 and a gray-scale voltage V127 output from the seventh selector MUX7, and outputs the divided voltages to the sixth selector MUX6. The sixth selector MUX6 selects one voltage candidate corresponding to a value GT4 of 6 bits of the gamma circuit control signal GCON from among the voltage candidates output from the fifth ladder resistor 830, and outputs the selected voltage candidate as an $83^{rd}$ gray-scale voltage V83.

The sixth ladder resistor 832 divides a voltage between the gray-scale voltage V0 output from the first selector MUX1 and a gray-scale voltage V191 output from the eighth selector MUX8, and outputs the divided voltages to the seventh selector MUX7. The seventh selector MUX7 selects one voltage candidate corresponding to a value GT5 of 6 bits of the gamma circuit control signal GCON from among the voltage candidates output from the sixth ladder resistor 832, and outputs the selected voltage candidate as a $127^{th}$ gray-scale voltage V127.

The seventh ladder resistor 834 divides a voltage between the gray-scale voltage V0 output from the first selector MUX1 and the lowest gray-scale voltage V255 output from the second selector MUX2, and outputs the divided voltages to the eighth selector MUX8. The eighth selector MUX8 selects one voltage candidate corresponding to a value GT6 of 6 bits of the gamma circuit control signal GCON from among the voltage candidates output from the seventh ladder resistor 834, and outputs the selected voltage candidate as a $191^{st}$ gray-scale voltage V191.

The gray-scale voltage output unit 836 generates the $0^{th}$ to $255^{th}$ gray-scale voltages V0 to V255 from the third to eighth selectors MUX3 to MUX8, and outputs the $0^{th}$ to $255^{th}$ gray-scale voltages V0 to V255 to the data driver 120. The gray-scale voltage output unit 836 can generate the $0^{th}$ to $255^{th}$ gray-scale voltages V0 to V255 by dividing the reference voltages V0, V5, V15, V31, V83, V127, V191, and V255 input thereto with resistor components connected in series.

Figure 9:
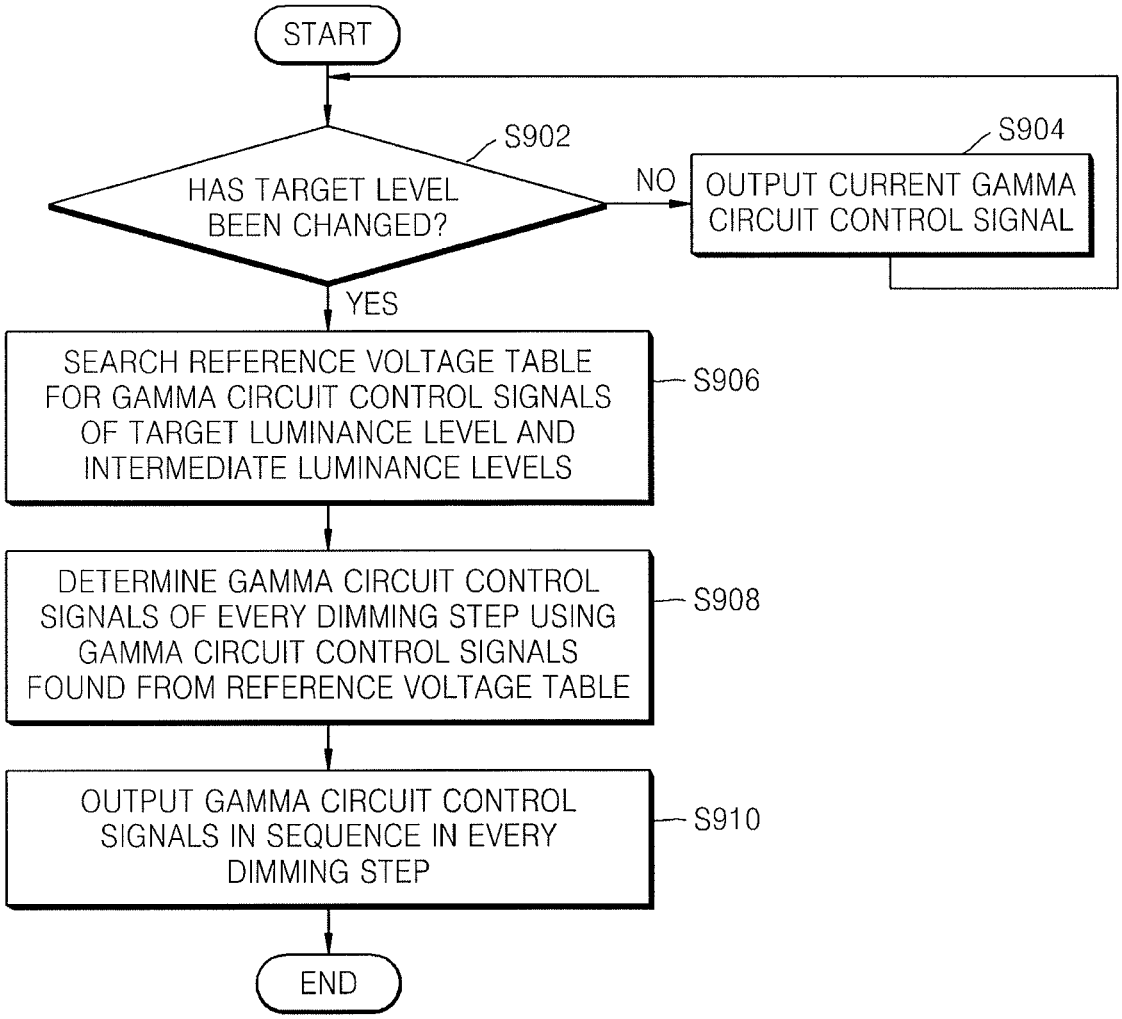
FIG. 9 illustrates a flowchart of a method for generating a gray-scale voltage, according to an exemplary embodiment.

FIG. 9 is a flowchart illustrating a method for generating a gray-scale voltage according to an exemplary embodiment.

Referring to FIG. 9, if a target luminance level is not changed in operation S902, the gamma circuit control signal generator 704*a* in operation 5904 outputs a currently output gamma circuit control signal GCON to the gamma correction circuit 708 via the gamma circuit control signal output unit 706.

If the target luminance level is changed in operation S902, the gamma circuit control signal generator 704*a* searches a reference voltage table for a gamma circuit control signal GCON of the target luminance level and gamma circuit control signals GCON of intermediate luminance levels between a current luminance level and the target luminance level in operation S906. Thereafter, the gamma circuit control signal generator 704*a* determines gamma circuit control signals GCON of the intermediate luminance levels and the target luminance level using the gamma circuit control signals GCON found from the reference voltage table in operation S908. In operation 910, there is a sequentially output of the gamma circuit control signals GCON to the gamma correction circuit 708 in every dimming step. The gamma circuit control signals GCON are being synchronized with the gamma circuit clock signal GCK. The gamma correction circuit 708 updates the gray-scale voltages V0 to V255 in steps according to the received gamma circuit control signals GCON.

Figure 10:
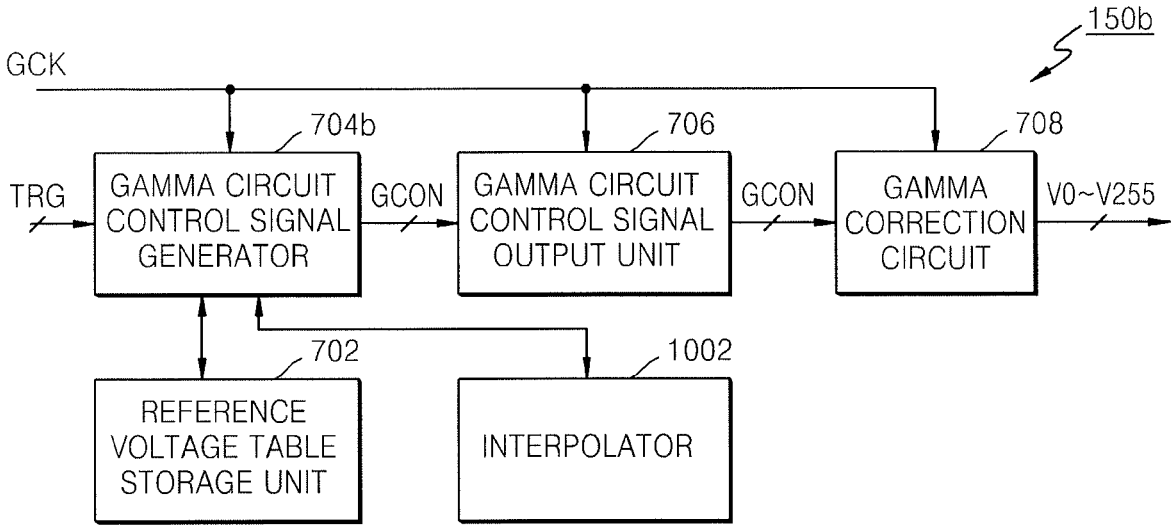
FIG. 10 illustrates a block diagram of a gray-scale voltage generator according to another exemplary embodiment.

FIG. 10 is a block diagram illustrating a gray-scale voltage generator 150*b* according to another exemplary embodiment.

Referring to FIG. 10, the gray-scale voltage generator 150*b* includes the reference voltage table storage unit 702, a gamma circuit control signal generator 704*b*, the gamma circuit control signal output unit 706, the gamma correction circuit 708, and an interpolator 1002.

According to another exemplary embodiment, the gamma circuit control signal generator 704*b* determines intermediate luminance levels in order to perform dimming through a predetermined number of dimming steps. Gamma circuit control signals GCON corresponding to the intermediate luminance levels and a target luminance level are searched in the reference voltage table storage unit 702, and if the number of luminance levels is not enough to perform the dimming through the predetermined number of dimming steps, the gamma circuit control signal generator 704*b* controls the interpolator 1002 to calculate additional intermediate luminance levels.

Figure 12:
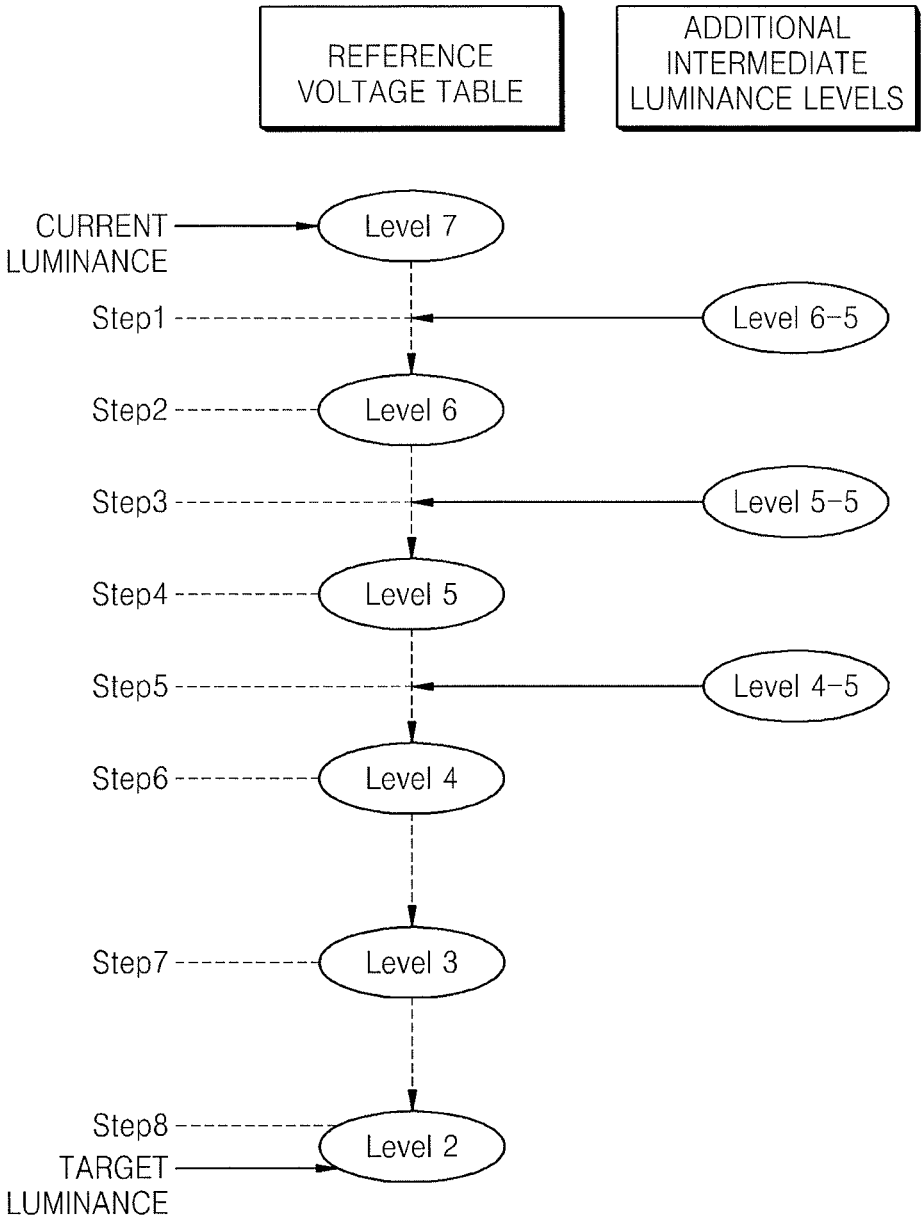
FIG. 12 illustrates a diagram of determining additional intermediate luminance levels according to an exemplary embodiment.

FIG. 12 is a diagram of determining additional intermediate luminance levels according to an exemplary embodiment of the present invention.

FIG. 12 illustrates a dimming operation in a case where a current luminance level is Level 7 and a target luminance level is Level 2. The interpolator 1002 determines additional intermediate luminance levels by interpolating between intermediate luminance levels and a target luminance level searched in the reference voltage table storage unit 702. The interpreter 1002 determines gamma circuit control signals GCON corresponding to the additional intermediate luminance levels. Referring to FIG. 12, when dimming is performed through 8 steps, 7 intermediate luminance levels are necessary. According to the example shown in FIG. 12, 4 luminance levels, i.e., Level 6, Level 5, Level 4, and Level 3, between the current luminance level and the target luminance level, are searched from a reference voltage table. Thus, the interpolator 1002 determines additional intermediate luminance levels between the luminance levels searched from the reference voltage table using interpolation. For example, as shown in FIG. 12, the interpolator 1002 determines an additional intermediate luminance level Level 6-5 by interpolating between Level 7 and Level 6, an additional intermediate luminance level Level 5-5 by interpolating between Level 6 and Level 5, and an additional intermediate luminance level Level 4-5 by interpolating between Level 5 and Level 4.

The interpolator 1002 can generate gamma circuit control signals GCON corresponding to the additional intermediate luminance levels. For example, the gamma circuit control signals GCON corresponding to the additional intermediate luminance levels can be determined using a lookup table.

According to another exemplary embodiment, if the target luminance level is not stored in the reference voltage table, the gamma circuit control signal generator 704*b* controls the interpolator 1002. The gamma circuit control signal generator 704*b* controls the interpolator 1002 to generate a gamma circuit control signal GCON corresponding to the target luminance level using luminance levels corresponding to gamma circuit control signals GCON found from the reference voltage table. The gamma circuit control signals GCON themselves can be interpolated. In addition, parameters associated with the gamma circuit control signals GCON, e.g., reference voltage levels, can be interpolated.

According to another exemplary embodiment, the organic electroluminescent display device 100 or an electronic device using the organic electroluminescent display device 100 can be controlled to select a target luminance level from luminance levels only included in a reference voltage table. For example, according to exemplary embodiments, if a luminance level of the organic electroluminescent display device 100 is adjusted according to a user's selection, thereby performing a luminance level control by adjusting voltage levels of gray-scale voltages V0 to V255, the user can only select a luminance level from luminance levels included in a reference voltage table. This prevents color temperature from being changed in the target luminance level of the organic electroluminescent display device 100.

The interpolator 1002 can independently perform interpolation for R, G, and B. The interpolator 1002 can determine additional intermediate luminance levels and additional gamma circuit control signals GCON for R by searching the reference voltage table for gamma circuit control signals GCON for R, additional intermediate luminance levels and additional gamma circuit control signals GCON for G by searching the reference voltage table for gamma circuit control signals GCON for G, and additional intermediate luminance levels and additional gamma circuit control signals GCON for B by searching the reference voltage table for gamma circuit control signals GCON for B.

The gamma circuit control signal generator 704*b* sequentially outputs the gamma circuit control signals GCON via the gamma control circuit control signal output unit 706. The gamma circuit control signals GCON are found from the reference voltage table storage unit 702 and the gamma circuit control signals GCON generated by the interpolator 1002 via the gamma circuit control signal output unit 706. The gamma circuit control signal output unit 706 outputs the gamma circuit control signals GCON generated by the gamma circuit control signal generator 704*b* in synchronization with the gamma circuit clock signal GCK. The gamma correction circuit 708 generates and outputs gray-scale voltages V0 to V255 according to the gamma circuit control signals GCON.

Figure 11:
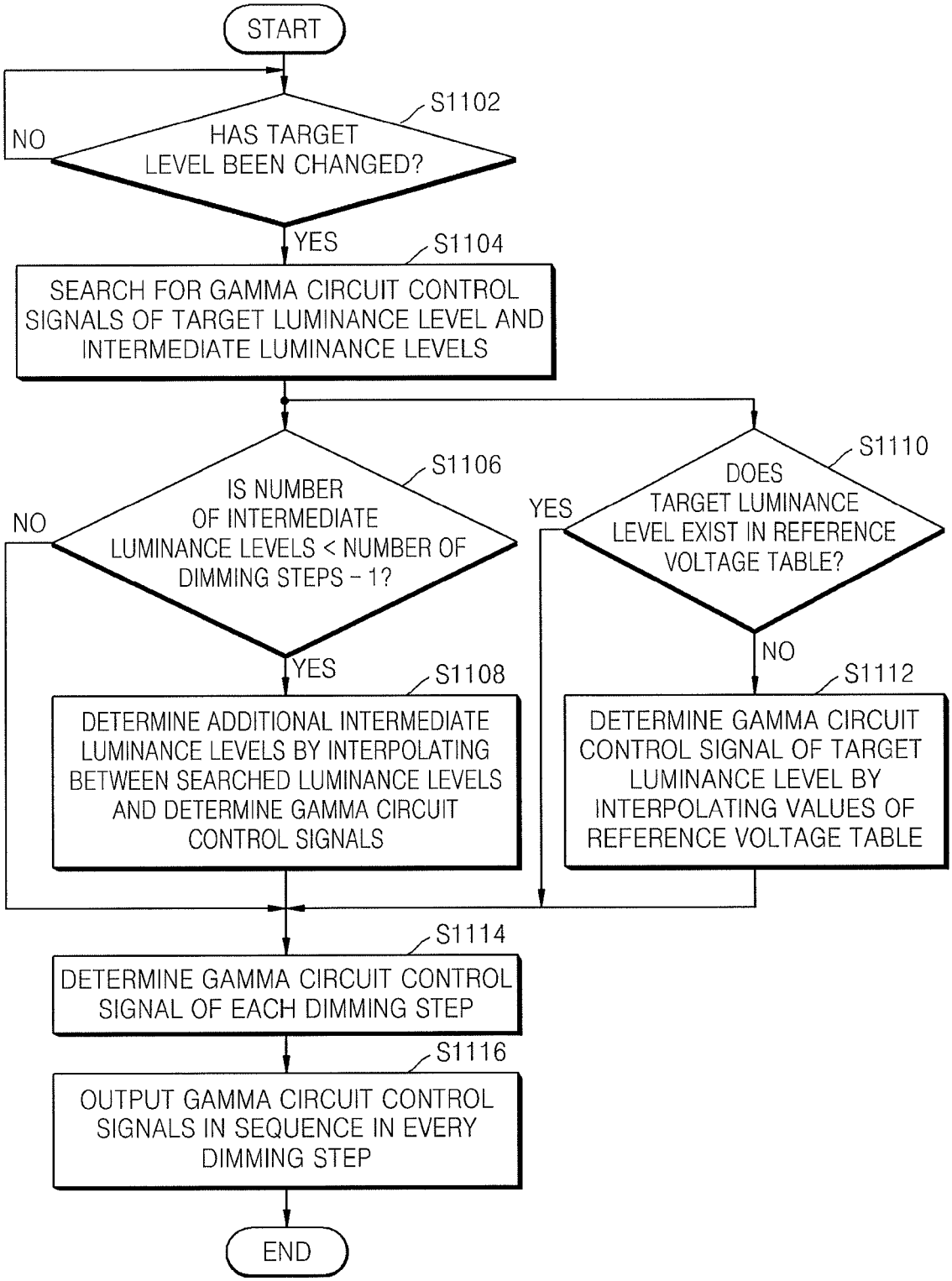
FIG. 11 illustrates a flowchart of a method for generating a gray-scale voltage, according to another exemplary embodiment.

FIG. 11 is a flowchart illustrating a method for generating a gray-scale voltage, according to another exemplary embodiment.

Referring to FIG. 11, if a target luminance level is changed in operation S1102, the gamma circuit control signal generator 704*b* searches the reference voltage table of the reference voltage table storage unit 702 for gamma circuit control signals GCON corresponding to the target luminance level and intermediate luminance levels in operation S1104.

In operation S1106, if the number of intermediate luminance levels searched from the reference voltage table is less than a value, i.e. the number of predetermined dimming steps—1 in FIG. 11, additional intermediate luminance levels are determined by interpolating between the intermediate luminance levels, and gamma circuit control signals GCON. The gamma circuit control signals GCON correspond to the additional intermediate luminance levels generated in operations S1108.

If the target luminance level does not exist in the reference voltage table in operation S1110, a gamma circuit control signal GCON of the target luminance level is determined by interpolating two luminance levels adjacent to the target luminance level in operation S1112.

In operation S1114, gamma circuit control signals GCON of respective dimming steps are determined. If all of the target luminance level and the intermediate luminance levels are searched from the reference voltage table, gamma circuit control signals GCON found from the reference voltage table are used. If at least one of the target luminance level and the intermediate luminance levels is determined by interpolation, gamma circuit control signals GCON found from the reference voltage table and gamma circuit control signals GCON generated by the interpolator 1002 are used.

In operation S1116, the gamma circuit control signal generator 704*b* outputs the gamma circuit control signals GCON to the gamma correction circuit 708 via the gamma circuit control signal output unit 706 in every dimming step.

By way of summation and review, according to the exemplary embodiments described above, an organic electroluminescent display device can provide natural dimming. In addition, when the organic electroluminescent display device performs dimming by adjusting gray-scale voltages, the dimming can be performed without a change of color temperature.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method for generating a gray-scale voltage in a display device, the method comprising:

displaying an image at a current luminance level;

after displaying the image at the current luminance level, receiving a target luminance level different from the current luminance level;

searching a reference voltage table containing gamma circuit control signals for a plurality of luminance levels for a gamma circuit control signal for the target luminance level and a gamma circuit control signal for at least one intermediate luminance level among a number of intermediate luminance levels between the current luminance level and the target luminance level;

determining whether the number of intermediate luminance levels searched from the reference voltage table are not enough gray-scale voltage of the display device;

determining, if the number of intermediate luminance levels are not enough, at least one additional intermediate luminance level by interpolating among the current luminance level, the intermediate luminance levels, and the target luminance level searched from the reference voltage table;

generating a gamma circuit control signal corresponding to the at least one additional intermediate luminance level; and adjusting a luminance level by adjusting gray-scale voltages of the display device through a plurality of steps from the current luminance level to the target luminance level using the gamma circuit control signals found from the reference voltage table, and the gamma circuit control signal corresponds to the at least one additional intermediate luminance level, wherein the gamma circuit control signals are control signals for controlling voltage levels of the gray-scale voltages of the display device.

2. The method as claimed in claim 1, wherein the gamma circuit control signals are control signals for determining voltage levels of a plurality of reference voltages used for generating the gray-scale voltages.

3. The method as claimed in claim 1, wherein the reference voltage table includes gamma circuit control signals for color components corresponding to respective sub-pixels on the plurality of luminance levels.

4. The method as claimed in claim 1, wherein the reference voltage table includes gamma circuit control signals adjusted not to change color temperature of an image displayed on the display device in the plurality of luminance levels.

5. The method as claimed in claim 1, further comprising:

determining whether the target luminance level exists in the reference voltage table; and generating, if the target luminance level does not exist in the reference voltage table, the gamma circuit control signal corresponding to the target luminance level by interpolating the gamma circuit control signals for the luminance levels included in the reference voltage table or parameters related to the gamma circuit control signals.

6. The method as claimed in claim 1, wherein the target luminance level is determined according to a user's input for adjusting a luminance level.

7. The method as claimed in claim 6, wherein the user's input for adjusting a luminance level is limited to selecting the luminance level from only the luminance levels included in the reference voltage table.

8. The method as claimed in claim 1, wherein the display device is an organic electroluminescent display device.

9. An apparatus for generating a gray-scale voltage in a display device, the apparatus comprising:

a gamma correction circuit for generating and outputting a plurality of gray-scale voltages;

a reference voltage table storage for storing a reference voltage table containing gamma circuit control signals for controlling the gamma correction circuit for a plurality of luminance levels;

an interpolator for determining, if the plurality of luminance levels searched from the reference voltage table are not enough to adjust the gray-scale voltages of the display device, at least one additional intermediate luminance level by interpolating among a current luminance level, an intermediate luminance level, and a target luminance level searched from the reference voltage table and generating the gamma circuit control signals corresponding to the at least one additional intermediate luminance level; and a gamma circuit control signal generator for receiving the current luminance level of an image being displayed and, after displaying the image having the current luminance level, receiving the target luminance level, and if the current luminance level is different from the target luminance level, searching the reference voltage table for a gamma circuit control signal for the target luminance level and a gamma circuit control signal for at least one intermediate luminance level between the current luminance level and the target luminance level, and controlling to adjust a luminance level of the display device by adjusting the plurality of gray-scale voltages through a plurality of steps from the current luminance level to the target luminance level using the gamma circuit control signals found from the reference voltage table and the gamma circuit control signal corresponding to the at least one additional intermediate luminance level.

10. The apparatus as claimed in claim 9, wherein the gamma circuit control signals are control signals for determining voltage levels of a plurality of reference voltages used for generating the gray-scale voltages in the gamma correction circuit.

11. The apparatus as claimed in claim 9, wherein the reference voltage table includes gamma circuit control signals for color components corresponding to respective sub-pixels on the plurality of luminance levels.

12. The apparatus as claimed in claim 9, wherein the reference voltage table includes gamma circuit control signals adjusted not to change color temperature of an image displayed on the display device in the plurality of luminance levels.

13. The apparatus as claimed in claim 9, further comprising an interpolator for, if the target luminance level does not exist in the reference voltage table, generating the gamma circuit control signal corresponding to the target luminance level by interpolating the gamma circuit control signals for the luminance levels included in the reference voltage table or parameters related to the gamma circuit control signals.

14. The apparatus as claimed in claim 9, wherein the target luminance level is determined according to a user's input for adjusting a luminance level.

15. The apparatus as claimed in claim 14, wherein the user's input for adjusting a luminance level is limited to selecting the luminance level from only the luminance levels included in the reference voltage table.

16. The apparatus as claimed in claim 9, wherein the display device is an organic electroluminescent display device.

17. An organic electroluminescent display device, comprising:

a plurality of pixels disposed on crossing points between data lines and scanning lines;

a gate driver for outputting scanning signals to the plurality of pixels through the scanning lines, respectively;

a data driver for generating data voltages corresponding to an input image input to the organic electroluminescent display device from a plurality of gray-scale voltages and outputting the data voltages to the plurality of pixels through the data lines, respectively, to display the input image at a current luminance level; and a gray-scale voltage generator for generating the plurality of gray-scale voltages and outputting the plurality of gray-scale voltages to the data driver, wherein the gray-scale voltage generator includes:

a gamma correction circuit for generating and outputting a plurality of gray-scale voltages;

a reference voltage table storage unit for storing a reference voltage table containing gamma circuit control signals for controlling the gamma correction circuit for a plurality of luminance levels;

an interpolator for, if a number of intermediate luminance levels searched from the reference voltage table is not enough to adjust the plurality of gray-scale voltages of the organic electroluminescent display device, determining at least one additional intermediate luminance level by interpolating among the current luminance level, an intermediate luminance level, and a target luminance level searched from the reference voltage table, and generating a gamma circuit control signal corresponding to the at least one additional intermediate luminance level; and a gamma circuit control signal generator for receiving, after displaying the input image at the current luminance level, the target luminance level, and, if the current luminance level is different from the target luminance level, searching the reference voltage table for a gamma circuit control signal for the target luminance level and a gamma circuit control signal for at least one intermediate luminance level between the current luminance level and the target luminance level, and controlling to adjust a luminance level of the organic electroluminescent display device by adjusting the plurality of gray-scale voltages through a plurality of steps from the current luminance level to the target luminance level using the gamma circuit control signal found from the reference voltage table and the gamma circuit control signal corresponding to the at least one additional intermediate luminance level.

18. The organic electroluminescent display device as claimed in claim 17, wherein the gamma circuit control signals are control signals for determining voltage levels of a plurality of reference voltages used for generating the gray-scale voltages in the gamma correction circuit.

19. The organic electroluminescent display device as claimed in claim 17, wherein the reference voltage table includes gamma circuit control signals for color components corresponding to respective sub-pixels on the plurality of luminance levels.

20. The organic electroluminescent display device as claimed in claim 17, wherein the reference voltage table includes gamma circuit control signals adjusted not to change color temperature of an image displayed on the display device in the plurality of luminance levels.

21. The organic electroluminescent display device as claimed in claim 17, further comprising an interpolator for generating, if the target luminance level does not exist in the reference voltage table, the gamma circuit control signal corresponding to the target luminance level by interpolating the gamma circuit control signals for the luminance levels included in the reference voltage table or parameters related to the gamma circuit control signals.

22. The organic electroluminescent display device as claimed in claim 17, wherein the target luminance level is determined according to a user's input for adjusting a luminance level.

23. The organic electroluminescent display device as claimed in claim 22, wherein the user's input for adjusting a luminance level is limited to selecting the luminance level from only the luminance levels included in the reference voltage table.

* * * * *